US008319194B2

(12) United States Patent
Hashimoto et al.

(10) Patent No.: US 8,319,194 B2
(45) Date of Patent: Nov. 27, 2012

(54) DRUG DETECTION EQUIPMENT

(75) Inventors: Makoto Hashimoto, Hitachinaka (JP); Takefumi Yokokura, Kasama (JP); Masuyoshi Yamada, Ichikawa (JP); Hiroyuki Inoue, Kashiwa (JP); Hidetoshi Morokuma, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/214,654

(22) Filed: Aug. 22, 2011

(65) Prior Publication Data

US 2012/0049055 A1 Mar. 1, 2012

(30) Foreign Application Priority Data

Aug. 25, 2010 (JP) ..... 2010-187715

(51) Int. Cl.
*H01J 49/04* (2006.01)
*H01J 49/26* (2006.01)

(52) U.S. Cl. ..... 250/425; 250/423 R; 250/282

(58) Field of Classification Search ..... 250/281, 250/282, 288, 289, 423 R, 424, 425, 428, 250/429
See application file for complete search history.

(56) References Cited

U.S. PATENT DOCUMENTS

| | | | | |
|---|---|---|---|---|
| 5,175,431 | A * | 12/1992 | Eisele et al. | 250/288 |
| 5,969,352 | A * | 10/1999 | French et al. | 250/288 |
| 6,639,215 | B2 * | 10/2003 | Takada et al. | 250/288 |
| 7,064,320 | B2 * | 6/2006 | Yamada et al. | 250/288 |
| 7,247,495 | B2 * | 7/2007 | Amirav | 436/173 |
| 2003/0003595 | A1 * | 1/2003 | Amirav | 436/173 |
| 2003/0015657 | A1 * | 1/2003 | Takada et al. | 250/288 |
| 2005/0017164 | A1 * | 1/2005 | Mukaibatake | 250/288 |
| 2006/0054806 | A1 * | 3/2006 | Yamada et al. | 250/288 |
| 2012/0183696 | A1 * | 7/2012 | Park et al. | 427/372.2 |

FOREIGN PATENT DOCUMENTS

| | | |
|---|---|---|
| JP | 04-184253 | 7/1992 |
| JP | 07-140130 | 6/1995 |
| JP | 08-27275 | 3/1996 |
| JP | 2006-086002 | 3/2006 |
| JP | 2008-051520 | 3/2008 |
| JP | 3156553 | 1/2010 |

OTHER PUBLICATIONS

"Ion-Molecule Reactions in Pure Nitrogen and Nitrogen Containing Traces of Water at Total Pressures 0.5-4 torr. Kinetics of Clustering Reactions Forming H+(H20)" Good, et al. The Journal of Chemical Physics. Vo. 52 No. 1, p. 212. Jan. 1, 1970.

(Continued)

*Primary Examiner* — Bernard E Souw
(74) *Attorney, Agent, or Firm* — McDermott Will & Emery LLP

(57) ABSTRACT

The mass spectrometer includes an ion source; a mass spectrometry part; a sample container; a heater for the sample container; a first gas tube connected to the sample container to introduce a gas into the sample container; and a second gas tube connected to the sample container to transfer a headspace gas of the sample container to the ion source, in which the ion source generates ions of the headspace gas and the mass spectrometry part performs mass spectrometry of the ions.
Thereby, the mass spectrometer as a drug detection equipment can analyze various drugs in urine rapidly and with high sensitivity.

19 Claims, 11 Drawing Sheets

OTHER PUBLICATIONS

"Thermal Desorption Counter-flow Introduction Atmospheric Pressure Chemical Ionization for Direct Mass Spectrometry of Ecstasy Tablets". Inoue et al. Journal of Mass Spectrometry. Vo., 44, p. 1300-1307. May 28, 2009.

Sousanotameno Houkagaku, Second Section, <Houkougaku, Houkagaku>, Reibunsha, p. 272-278 (Forensic Science for Investigation <Forensic Engineering and Forensic Chemistry> (Partial English Translation).

Yakudokubutsu Shikenhou to Tyuukai 2006, -Bunseki, Dokusei, Taisyohou-, Tokyo Kagaku Dojin, p. 131-145, p. 175-185 (Test Methods for Drugs and Toxic Substances, and Exposition, -Analysis, Toxicity, and Coping Techniques-) (Partial English Translation).

* cited by examiner

DRUG DETECTION EQUIPMENT

CLAIM OF PRIORITY

The present application claims priority from Japanese Patent application serial No. 2010-187715, filed on Aug. 25, 2010, the content of which is hereby incorporated by reference into this application.

BACKGROUND OF THE INVENTION

1. Field of the Invention

The present invention relates to drug detection equipment.

2. Description of Related Art

Each following term is abbreviated as follows. Gas Chromatograph: GC, Equipment Combining Gas Chromatograph and Mass Spectrometer: GC/MS, Atmospheric Pressure Chemical Ionization: APCI, Chemical Ionization: CI and Electron Ionization: EI.

Reagent kits using immunization, etc. have been used as detection of illegal drugs such as stimulant drugs and narcotic drugs at field inspection of crime scenes. When an examination method with the reagent kit is used, false positive may be obtained by a substance having a similar structure. A simple detection method having higher detection sensitivity has been required.

Japanese Patent Laid-Open No. Hei 4-184253 (Patent Document 1) discloses a technology in which stimulant drugs in urine are analyzed by introducing headspace gas in an airtight container enclosing urine into a GC.

Japanese Patent Laid-Open No. 2006-86002(Patent Document 2) describes a configuration which intends to obtain higher sensitivity by separating a sample gas with a GC column and locating an outlet of the GC column in an ion-molecule reaction region of an APCI ion source.

Japanese Patent Laid-Open No. 2008-51520 (Patent Document 3) describes a method in which a liquid sample containing drugs is dropped to a cloth and is vaporized by sandwiching the cloth with upper and lower heating heaters, and then the vaporized sample is analyzed with an ion-trap type mass spectrometer.

In "Sousanotameno Houkagaku, Second Section, <Houkougaku, Houkagaku>, Reibunsha, p. 272-278 (Forensic Science for Investigation <Forensic Engineering and Forensic Chemistry>)" (Non-Patent Document 3), it is described that components of stimulant drugs are volatilized from urine and transferred to a vapor phase (headspace) by heat of dissolution of potassium carbonate and a liquid property (alkaline). In addition, in Non-Patent Document 3, a reagent kit for pretest using an antigen-antibody reaction by using monoclonal antibodies of various kinds of illegal drugs other than color reactions is described.

Japanese Utility Model Registration No. 3156553 (Patent Document 4) discloses a pretest kit for stimulant drugs which enables simple handling and rapid detection by using determination by color reactions.

In "Yakudokubutsu shikenhou to tyuukai 2006, —Bunseki, Dokusei, Taisyohou—, Tokyo Kagaku Dojin, p. 131-145, p. 175-185 (Test Methods for Drugs and Toxic Substances, and Exposition, —Analysis, Toxicity and Coping Technique—) (Non-Patent Document 4), there are descriptions about a color test of cannabis, use of color reaction in a qualitative test of cocaine and a color test for pretest of opium.

Japanese Examined Patent Publication No. Hei 8-27275 (Patent Document 5) discloses a detection method and a detection kit for opium using a color reaction.

SUMMARY OF THE INVENTION

A mass spectrometer of the present invention includes an ionization part; amass spectrometry part; a sample container; and a sample heating part for heating the sample container; in which a space part being gas phase is provided in the sample container, and an accompanied gas introducing tube for introducing accompanied gas to the sample container and a sample gas introducing tube for transferring sample gas in the space part to the ionization part are connected to the sample container; and in which the ionization part generates ions of the sample gas and the mass spectrometry part performs mass spectrometry of the ions.

According to the present invention, various drugs in the urine can be analyzed rapidly and with high sensitivity.

DETAILED DESCRIPTION OF THE INVENTION

Figure 1:
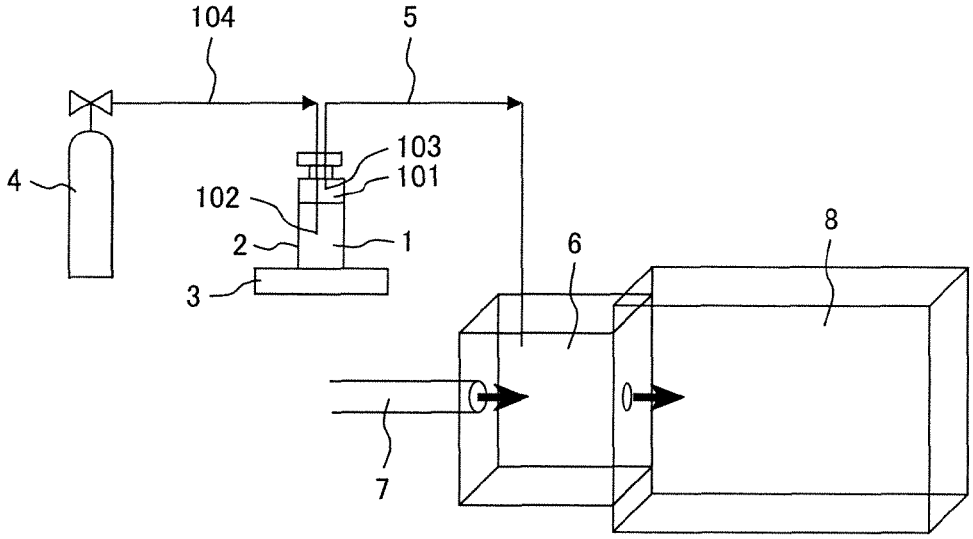
FIG. 1 is a schematic block diagram showing a mass spectrometer of an example.

There is room for improvement in that peaks of mass chromatogram becomes broad and substantial sensitivity is decreased due to adsorption of a target substance for measurement in a syringe when gas in headspace (a headspace gas) is sucked into the syringe and the gas in the syringe is discharged into a ion source inlet tube of a mass spectrometer using the method disclosed in Patent Document 1.

Patent Document 3 does not disclose response in the case that decrease in sensitivity is caused by introducing impurity components in urine and target substance for measurement into an analyzer at the same time by heating to disturb ionization.

In the pretest kit described in Patent Document 4, determination of the stimulant drug is based on comparison with color samples. Accordingly, there is possibility to cause erroneous determination of the color by sight in space such as inside of a car at inspection field of crime scenes.

In the various test kits described in Non-Patent Document 3, determination of the kits often depends on visual inspection by detectives. Therefore, there is a problem of erroneous determination. In addition, when the antigen-antibody reaction is used, correct determination may difficult because a cross-reaction with components in a medicine for a cold in the sample may occur.

Color reactions for a cannabis sample, cocaine, opium and the like are difficult to determine due to visual verification. Therefore, erroneous determination may occur. Extraction and purification operation of the sample for the color analysis is troublesome.

In the analysis of the cannabis sample described in Non-Patent Document 4, drug components are extracted from the sample using an organic solvent such as methanol. In addition, a hallucinatory component (target components for crackdown) in the cannabis is required to be separated and purified by repeating operation such as a liquid-liquid extraction.

When GC/MS analysis of opium described in Non-Patent Document 4 is performed, after performing extraction operation of opium alkaloids, derivatives thereof are formed and analyzed, derivatives of meconic acid, codeine and morphine can be detected. However, the operation for derivative formation is troublesome.

Detection of opium described in Patent Document 5 is required to be determined by water solubility and a color reaction of the sample.

Preparation methods of the samples of cannabis, cocaine and opium described in Non-Patent Document 4 and Patent Document 5 are different from each other.

An object of the present invention is to provide drug detection equipment for analyzing various drugs in urine rapidly and with high sensitivity.

The present invention relates to amass spectrometer for analyzing volatilized components in gas. In particular, the present invention relates to the mass spectrometer analyzing illegal drugs in urine.

In the present invention, headspace gas is continuously introduced into an atmospheric pressure chemical ionization part (an APCI part).

In the case of injection method using a syringe, several μL to 10 μL (microliter) of a sample is injected for several seconds (A signal forms a peak shape). On the contrary, stable signal intensity is obtained for several minutes by the method of the present invention because target gas for measurement is continuously introduced.

An amount of urine used for a sample is at most several mL to several tens mL (milliliter). As a result, a headspace volume in a container is several mL to several tens mL. On the other hand, a flow volume of gas required for a discharge part of APCI is several hundreds mL/min. Therefore, when headspace gas is flown into the ionization part at a flow volume of several hundreds mL/min, measurement sensitivity is decreased because of dilution of target components for measurement.

Consequently, the headspace gas is introduced to the ionization part at a flow volume of several mL/min, and gas required for discharge is introduced from a different line.

As another introduction method, a urine sample is injected and adsorbed in a capillary, Helium (He) at a flow volume of several mL/min which is similar volume to the above description is made to flow into the capillary and is introduced into the ionization part. At this time, when an adsorption part of the sample is heated and the heating temperature is raised gradually, impurity substances and a target substance for measurement in the urine are separated depending on time and are volatilized by the difference of volatility. Consequently, analysis can be performed with high sensitivity without disturbance of ionization by the impurity substances.

Hereinafter, a mass spectrometer and a method for mass spectrometry according to an embodiment of the present invention are described.

The mass spectrometer includes an ion source (an ionization part); a mass spectrometry part; a sample container for encapsulating a liquid sample in; and a heater for the sample container, in which the sample container has a space part (a headspace) for passing gas over the liquid sample, and an accompanied gas introducing tube (a first gas tube) for introducing accompanied gas to the sample container and a sample gas introducing tube (a second gas tube) for transferring sample gas in the space part to the ionization part are connected to the sample container. The mass spectrometer performs mass spectrometry of the gas ion in the space part generated in the ionization part.

In the mass spectrometer, a downstream end part of the first gas tube is inserted in the sample solution.

In the mass spectrometer, the downstream end part of the first gas tube is positioned in a headspace of the sample container.

In the mass spectrometer, an upstream end part of the second gas tube is positioned in the headspace of the sample container.

In the mass spectrometer, a temperature of the sample container is controlled by a temperature controller (a temperature control part) to increase a temperature of a sample in the sample container with time.

In the mass spectrometer, the temperature control part raises the temperature of the sample stepwise.

In the mass spectrometer, the temperature control part raises temperature of a liquid adsorption part by setting a temperature rise rate per unit time.

In the mass spectrometer, the sample container is a liquid adsorption part for adsorbing the liquid sample.

In the mass spectrometer, the liquid sample includes urine.

In the mass spectrometer, a sample in the sample container is solid, and the sample container has a liquid injection tube for injecting alkaline aqueous solution or distilled water for dissolving the sample.

The method for mass spectrometry includes the steps of encapsulating a sample in a sample container; introducing an accompanied gas into an inside of the sample container; vaporizing plural kinds of components included in the sample; forming a sample gas by mixing the components and the accompanied gas; and performing the mass spectrometry of the sample gas.

In the method, the mass spectrometry is performed for ions generated from the sample gas.

In the method, plural kinds of components included in the sample are vaporized from the sample with temperature of the sample being kept constant or at a controlled temperature.

In the method, the sample container is a liquid adsorption part for adsorbing a liquid sample.

In the method, the plural kinds of components included in the liquid sample are vaporized by heating the sample container and changing temperature of the sample with time.

In the method, plural kinds of components included in the sample are vaporized by raising temperature of the sample stepwise.

In the method, sample temperature rise rate per unit time is set and plural kinds of components included in the sample are vaporized from the sample by raising the temperature of the sample.

In the method, a liquid sample is adsorbed to the liquid adsorption part, the liquid adsorption part is heated, temperature of the liquid adsorption part is changed with time, and plural kinds of components included in the liquid sample are separated and vaporized to transfer to the mass spectrometry part.

In the method, plural kinds of components included in the liquid sample are vaporized with raising the temperature at the liquid adsorption part stepwise.

In the method, the temperature rise rate at the liquid adsorption part per unit time is set and plural kinds of components included in the liquid sample are vaporized with raising the temperature at the liquid adsorption part.

In the method, the liquid sample includes urine, and drugs and metabolized substances of the drugs included in the liquid sample are determined as targets of analysis.

In the method, an alkaline reagent is added to the liquid sample.

In the method, an alkaline aqueous solution is added to the liquid sample.

In the method, the liquid sample is diluted with adding distilled water.

In the method, the liquid sample is prepared with adding alkaline aqueous solution or distilled water to a solid sample.

In the method, liquid including a sample is heated to 60 to 160° C. and gas generated from the liquid is transferred to the mass spectrometry part.

Hereinafter, the present invention is described in detail with use of Examples.

Example 1

FIG. 1 is a schematic block diagram showing a mass spectrometer of Example 1.

In FIG. 1, the mass spectrometer has a configuration of connecting a vial container 2 (a sample container) for encapsulating a urine sample 1 (a liquid sample) in, a sample gas introducing tube 5, an ionization part 6 and a mass spectrometry part 8. In the ionization part 6, a discharge gas introducing tube 7 (an introducing tube of a gas for ionization) is connected.

In the vial container 2, gas is introduced from a gas cylinder 4 through a gas introducing tube 104. The gas is preferably air, nitrogen, helium, argon and the like. Although clean gas is preferable, atmospheric air is acceptable. The gas can be continuously introduced.

When the urine sample 1 is putted into the vial container 2, headspace 101 (a space part) is provided on top of the vial container 2. An upstream end part 103 of the sample gas introducing tube 5 is located at the headspace 101 as well as a downstream end part 102 of the gas introducing tube 104 is immersed into the urine sample 1.

The urine sample 1 putted into the vial container 2 is heated by a heating heater 3 (a sample heating part) to 40 to 80° C. The gas of about several mL to several tens mL is introduced from the gas cylinder 4 into the vial container 2 and the gas in the headspace 101 is pushed out and introduced into the ionization part 6.

The sample gas introducing tube 5 which introduces the headspace gas 101 in the vial container 2 into the ionization part 6 is preferably heated at about 200 to 250° C. in order to prevent adsorption of the urine sample 1. In addition, in order to ensure a certain degree of flow rate, it is preferable to use a capillary tube having an internal diameter $\phi$ of about 0.2 to 1 mm.

For the ionization part 6, a device which can generate molecular ions or their proton adducts such as APCI is preferably used. When EI ionization which is commonly used for gas analysis is used, fragment patterns of a part of illegal drugs are matched. As a result, separation is difficult. In addition, these drugs are not separated by a GC column for rapid analysis. Consequently, various components are introduced into the ionization part 6 at the same time. Therefore, in the case of the EI, the obtained spectrum is complex.

APCI which generates a molecular ion $M^+$ or its proton adduct $(M+H)^+$ has simple fragments and is suitable for detecting objective target components for measurement among various components. Ionization methods such as CI and DART (registered trademark) (Direct Analysis in Real Time) can be used other than the APCI.

Here, an example in which the APCI is used is described.

In addition, the case of urine is described in this Example. However, this Example is applicable for saliva and blood.

Figure 2:
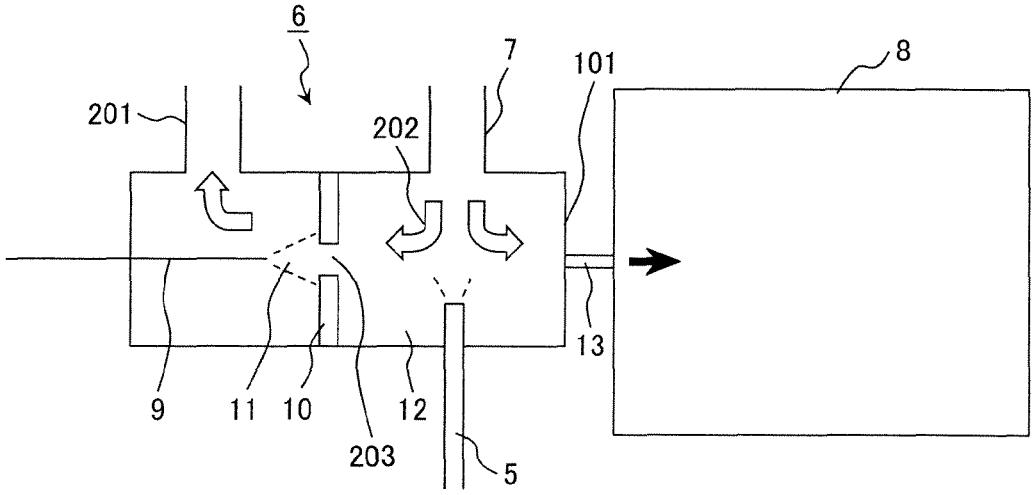
FIG. 2 is a detailed block diagram showing an ionization part of FIG. 1.

FIG. 2 is a detailed block diagram showing an ionization part of FIG. 1.

In this diagram, the ionization part 6 and the mass spectrometry part 8 are connected through ion entrapment pinhole 13. The sample gas introducing tube 5, the discharge gas introducing tube 7 and an exhaust tube 201 are connected to the ionization part 6. Discharge gas 202 (air) is introduced from the discharge gas introducing tube 7 to the ionization part 6 and exhausted from the exhaust tube 201.

The APCI is a method in which a voltage of several kV (kilovolt) is applied to a needle electrode 9, and molecules in the gas are ionized by corona discharge generated at the needlepoint. In order to maintain stable ionization, a discharge gas of several hundreds mL/min to several L/min is needed. The discharge gas 202 (air) is introduced from the discharge gas introducing tube 7 which is a different line from the sample gas introducing tube 5 for introducing the headspace gas.

A process in which illegal drugs are ionized is as follows.

Most of the illegal drugs are amine-based substances and can be ionized by cations with high sensitivity.

First, nitrogen in the air is changed into primary ions ($N_2^+$ or $N_4^+$) by following reaction formulae (1) or (2) in a corona discharge region 11 (refer to J. Chem. Phys., 52, 212 (1970): Non-Patent Document 1).

[Chemical Formula 1]

$$N_2 \rightarrow N_2^+ + e^- \qquad \text{Reaction Formula (1)}$$

[Chemical Formula 2]

$$N_2^+ + 2N_2 \rightarrow N_4^+ + N_2 \qquad \text{Reaction Formula (2)}$$

A primary ion introducing pinhole 203 having a diameter ϕ of about 2 mm is provided in an extracting electrode 10. The generated primary ions are introduced into an ion-molecular reaction region 12 by electric field.

In the ion-molecular reaction region 12, the primary ions generated in the corona discharge region 11 are reacted with the target substance for measurement included in the headspace gas (an ion-molecular reaction) and the sample gas ions (second ions: sample ions) are generated. In the case of drugs, a secondary ion to which a proton is added is generated mainly as $(M+H)^+$.

The headspace gas (the sample gas) is directly introduced from the sample gas introducing tube 5 to the ion-molecular reaction region 12. Consequently, the sample gas is effectively ionized without being diluted with the discharge gas 202. The headspace gas and the discharge gas 202 can be continuously supplied.

The generated secondary ions are introduced into the mass spectrometry part 8 through the ion entrapment pinhole 13 and detected by the detector.

For the method for mass spectrometry used, an ion mobility spectrometer and the like can be used other than various mass spectrometers such as a quadrupole mass spectrometer, an ion trap mass spectrometer, a time-of-flight mass spectrometer and a Fourier transform mass spectrometer.

Hereinafter, the case that a mass spectrometer is used as an example is described.

Since various impurity substances exist in components in urine, measurement using a tandem mass spectrometry is preferable.

In FIG. 1, in order to introduce the headspace gas 101 in the vial container 2, the downstream end part 102 of the gas introducing tube 104 is immersed into the urine sample 1 and the headspace gas 101 is introduced with bubbling. However, when the gas is introduced and bubbled in the urine sample 1, bubbles are generated at liquid level, or entrainment, in which liquid becomes droplets and the droplets are mixed with gas, is generated. Consequently, a concentration of drugs in urine at headspace 101 may become unstable. In order to prevent this, the gas may be introduced without the downstream end part 102 being immersed into the urine sample 1.

Figure 4:
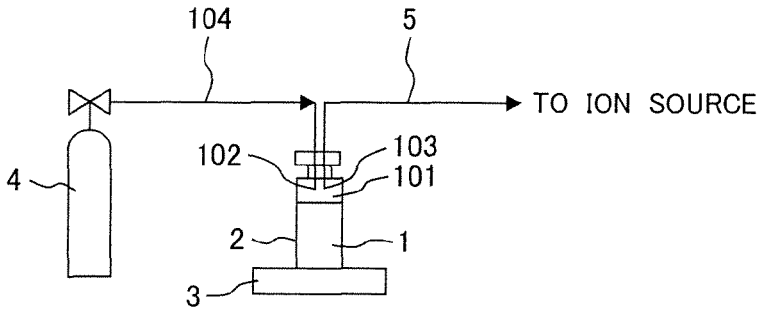
FIG. 4 is a partial block diagram showing a modified example of the mass spectrometer of FIG. 1.
Figure 5A:
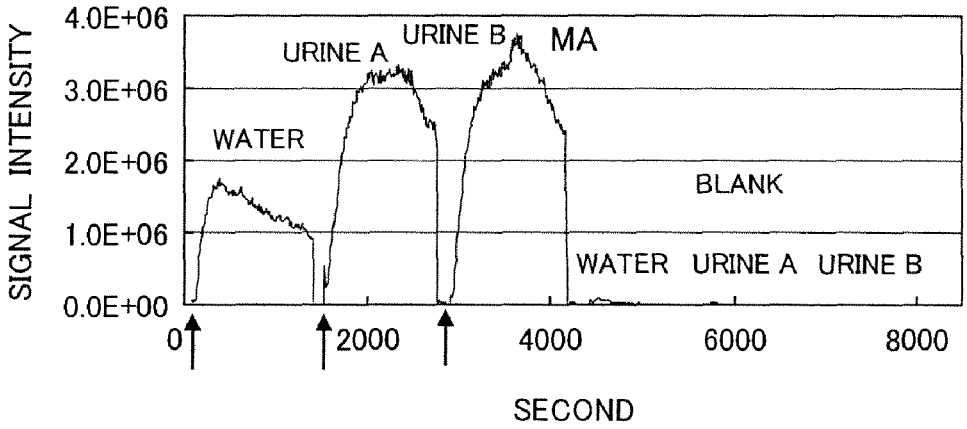
FIG. 5A is a graph showing a measurement result of a drug (Methamphetamine: MA) by the mass spectrometer in the example.
Figure 5B:
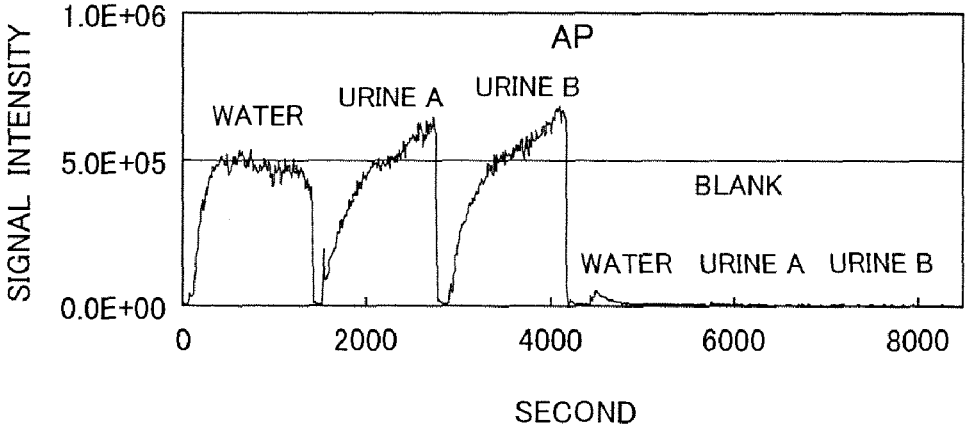
FIG. 5B is a graph showing a measurement result of a drug (Amphetamine: AP) by the mass spectrometer in the example.
Figure 5C:
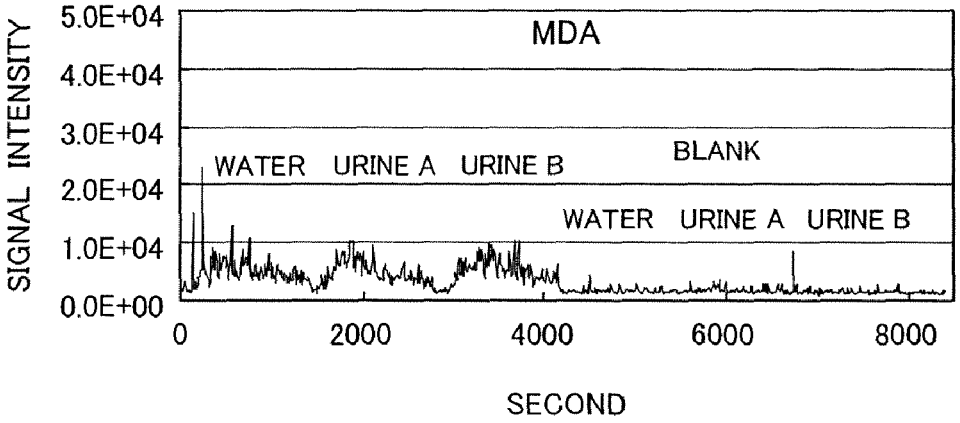
FIG. 5C is a graph showing a measurement result of a drug (3,4-Methylenedioxyamphetamine: MDA) by the mass spectrometer in the example.
Figure 5D:
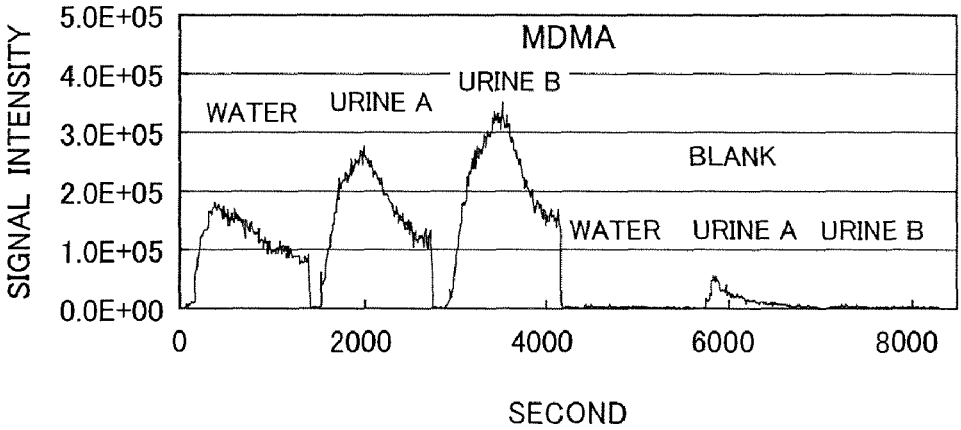
FIG. 5D is a graph showing a measurement result of a drug (3,4-Methylenedioxymethamphetamine: MDMA) by the mass spectrometer in the example.

FIG. 4 shows an example in which the downstream end part 102 of the gas introducing tube 104 is not immersed into the urine sample 1.

According to a configuration shown in this diagram, gas from the gas cylinder 4 is directly introduced into the headspace 101. Consequently, drugs volatilized from the urine sample 1 are mixed with the gas in the headspace 101 without generation of droplets and bubbles. Therefore, the drug concentration in the headspace 101 becomes stable.

In the mass spectrometer shown in FIGS. 1 and 4, temperature of the urine sample 1 enclosed in the vial container 2 may be raised stepwise or may be raised for predetermined heating time (heating period) by setting rate of temperature change per unit time (rate of temperature rise) by the heating heater 3 (the sample heating part). Here, start time of the heating time may be defined as after constant time from the measurement start time or defined as after heating under the other condition (another rate of temperature rise) until the temperature reaches to the predetermined temperature. In order to automatically control these temperatures, a temperature control part may be arranged in the mass spectrometer of this Example.

Figure 3:
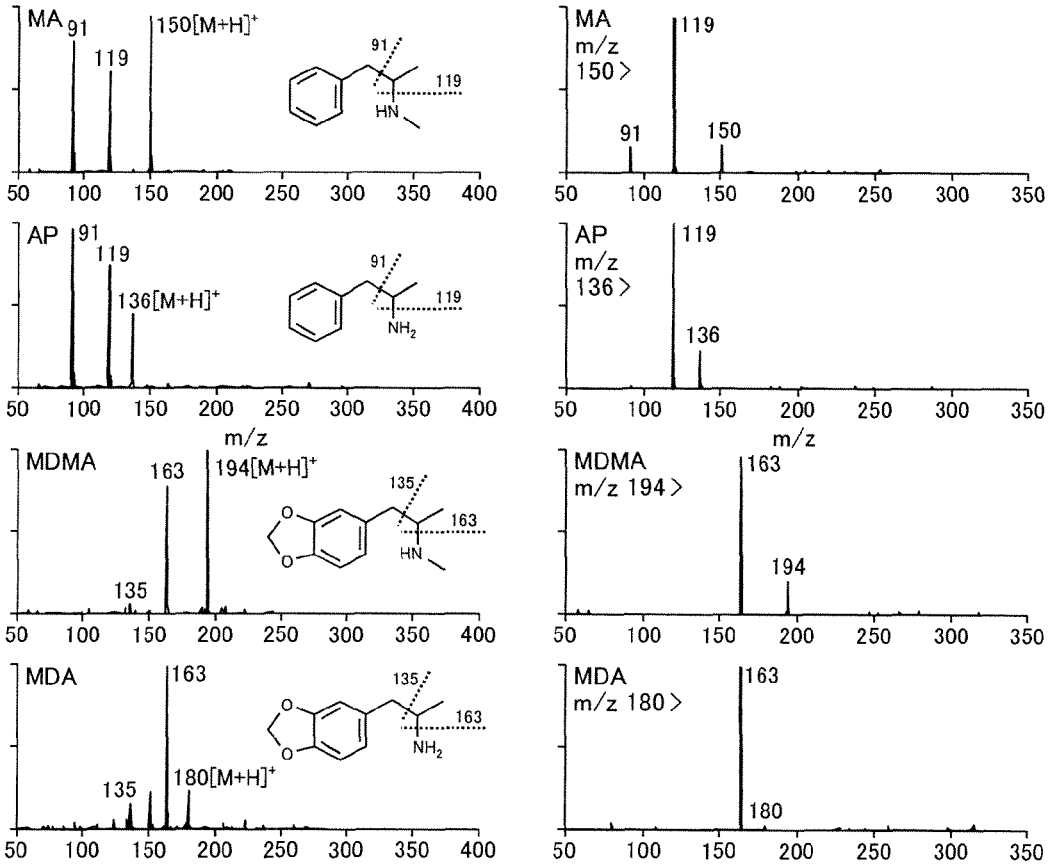
FIG. 3 is a graph showing mass spectra of drugs (common knowledge of one skilled in the art).

FIG. 3 is a graph showing an example of mass spectrum measured in atmospheric pressure chemical ionization (excerption from J. Mass Spectrom., 44, 1300 (2009): Non-Patent Document 2).

The left spectra are MS/pre-MS spectra and $(M+H)^+$ is detected as a main peak for each drug. The right spectra are MS/MS spectra obtaining $(M+H)^+$ as a precursor ion.

As described above, a target drug for measurement can be distinctively detected by selecting the precursor ion and by obtaining the MS/MS spectrum.

FIGS. 5A to 5D are graphs showing results obtained by measuring drugs in urine by the mass spectrometer shown in FIGS. 1 and 2.

Sample solution was prepared by adding 1 ppm of MA (Methamphetamine), AP (Amphetamine), MDA (3,4-Methylenedioxyamphetamine), and MDMA (3, 4-Methylenedioxymethamphetamine) to water and human urine (A and B), and measurement was performed using 2 mL of this sample solution. Arrows in the graph indicate timing in which He gas is started to be introduced. The solution was enclosed in the vial container 2 and was heated at 60° C. He was used as gas for introduction and measurement was performed by setting a flow rate to 4 mL/min.

From FIGS. 5A to 5D, it is found that signal intensity increases for every four drugs at the same time that He is started to be introduced and every four drugs are detected. On the contrary, it is found that signal intensity is not increased for a blank sample to which the illegal drugs are not added, and the illegal drugs are not detected.

As shown in FIGS. 5A to 5D, when the mass spectrometer shown in FIGS. 1 and 2 is used, headspace gas including target components for measurement (drugs in urine) is introduced for several tens minutes. More specifically, the headspace gas including the target components for measurement (the drugs in the urine) is mixed with the primary ions.

Consequently, this method has following advantages compared with headspace analysis using a syringe in which the signal is instantaneously detected.

(1) Signals can be confirmed in a plurality of measurement points. This leads to decrease in erroneous reports (mistaken measurements).

(2) Sufficient time for mass spectrometry can be ensured in the case of tandem mass spectrometry or in the case that a plurality of drugs are defined as target substances for measurement.

Moreover, when a syringe is used, the target components for measurement may be adsorbed in the syringe. However, according to this Example, the introducing tube is heated at about 200 to 250° C., so that little decrease in sensitivity is caused by adsorption.

On the other hand, in the case of the method in which a urine sample is dropped to a cloth and is heated and vaporized by sandwiching the cloth with upper and lower heaters as described in Patent Document 3, various impurity substances are also ionized at the same time. Consequently, an ionization reaction of the target drugs for measurement is suppressed and the sensitivity is decreased.

On the contrary, according to this Example, only headspace gas which is volatilized from a liquid sample heated to 40 to 80° C. is introduced into an ion source. Consequently, impurity substances in urine introduced into the ion source are limited to components volatilized in the headspace at a temperature of 40 to 80° C., and a concentration of impurity substances becomes low and types of impurity substances becomes less.

By the above-described operation, according to this Example, various drugs in the urine can be analyzed rapidly and with high sensitivity.

Example 2

In the method described in Patent Document 3, when the heating temperature is set to 40 to 80° C., a volatilization amount of volatilized impurity substances decreases. At the same time, a volatilization amount of objective target drugs for measurement also largely decreases because a dropped sample amount is as small as several tens microliter to several hundred microliter. Consequently, the concentration of the target drugs for measurement contained in the gas introduced into the ion source decreases and detection of the drugs becomes difficult.

Figure 6:
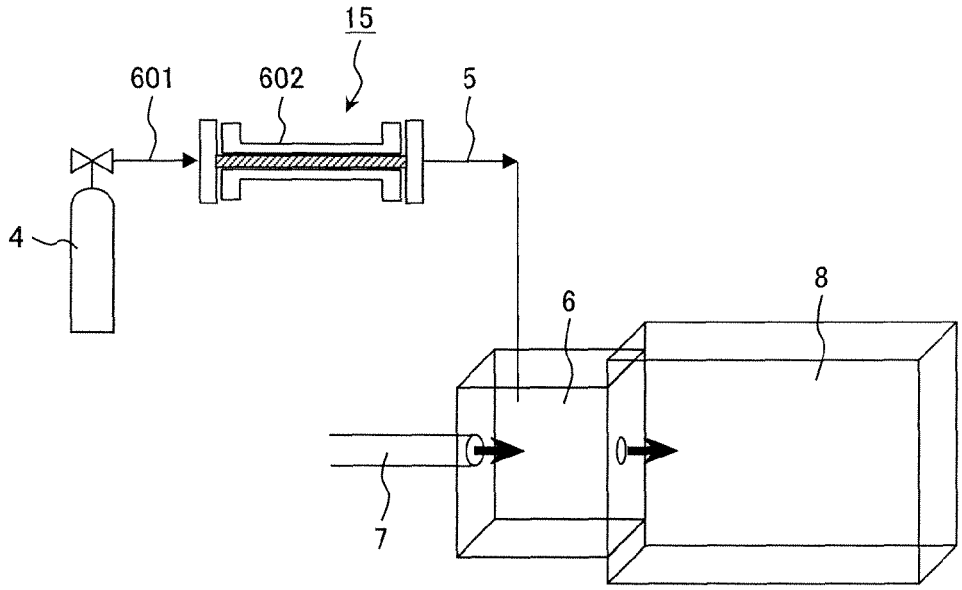
FIG. 6 is a schematic block diagram showing a mass spectrometer of another example.

Example shown in FIG. 6 is equipment for solving this problem. In other words, FIG. 6 shows a configuration example of a method for directly heating a liquid sample.

In this diagram, a liquid adsorption part 15 corresponding to the vial container 2 (the sample container) of FIG. 1 for adsorbing the liquid sample is used. A gas introducing tube 601 is connected to an inlet of the liquid adsorption part 15, and a sample gas introducing tube 5 is connected to an outlet of the liquid adsorption part 15. At the outlet, the sample gas introducing tube 5 as a capillary tube is connected to an ionization part 6 (an ion source) similar to FIG. 1. One to several tens μL of a urine sample is supplied to and immersed into the liquid adsorption part 15.

In the liquid adsorption part 15, a substance for adsorbing and retaining sample molecules on the solid surface such as TENAX (registered trademark) TA (manufactured by Buchem BV) is packed. Temperature of the liquid adsorption part 15 is raised by a heater 602 (a sample heating part) stepwise or at the rate of predetermined temperature rise with time. In other words, the temperature of the liquid adsorption part 15 may be raised stepwise, or may be raised for predetermined heating time (heating period) by setting rate of temperature change per unit time (rate of temperature rise) by the heater 602 (the sample heating part). Here, start time of the heating time may be set to after constant time from the measurement start time or set to after heating under the other condition (another rate of temperature rise) until the temperature reaches to the predetermined temperature.

Although not shown in the diagram, a temperature control part is desirably placed for controlling a heat release amount of the heater 602.

In this Example, a type of porous material is used for the liquid adsorption part 15. However, the material is not limited to the porous material and fibrous members such as clothes, glass fibers and carbon fibers may be used.

Figure 7:
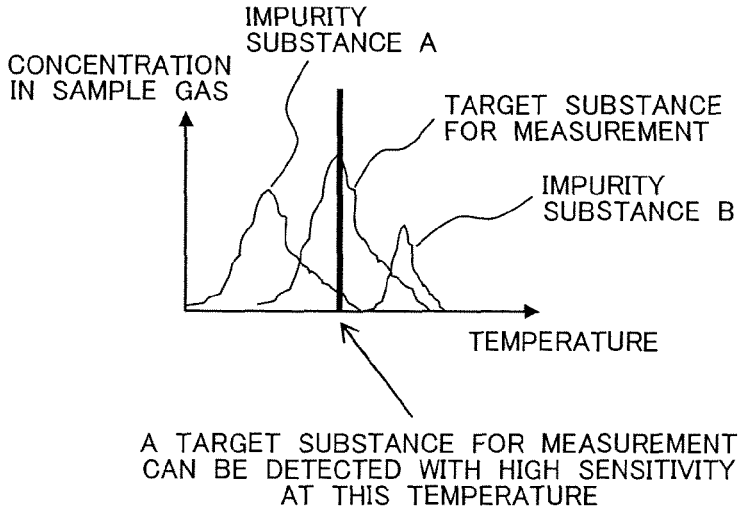
FIG. 7 is a graph illustrating a method for separating impurity substances and a target substance for measurement and detecting with the mass spectrometer of FIG. 6.

FIG. 7 is a graph illustrating a method for separating impurity substances and a target substance for measurement and measuring the target substances.

As shown in this graph, a drug and the impurity substances are separated by difference between a boiling point of the drug (or a temperature at which elimination from the liquid adsorption part becomes maximum) and a boiling point of the impurity substances (or a temperature at which elimination from the liquid adsorption part becomes maximum). As a result, disturbance of ionization by the impurity substances can be avoided and the drug can be measured with high sensitivity. More specifically, in this graph, when a temperature between a boiling point of the impurity substance A and a boiling point of the impurity substance B is a boiling point of the target drug for measurement, the target drug for measurement shows an independent concentration peak. Consequently, the target drug for measurement can be separately detected from the impurity substances.

Also in the method for analyzing the headspace gas shown in FIG. 1, a drug can be separately analyzed from the impurity substances by, for example, raising a temperature of the vial to 40° C. to 80° C. with time.

As described above, also in this Example, a various drugs in urine can be analyzed rapidly and with high sensitivity.

Example 3

In the methods described in Example 1 and Example 2, disturbance caused by impurity components in urine can be decreased. However, it is considered that effect of disturbance cannot be completely eliminated depending on individual difference of urines.

Figure 8A:
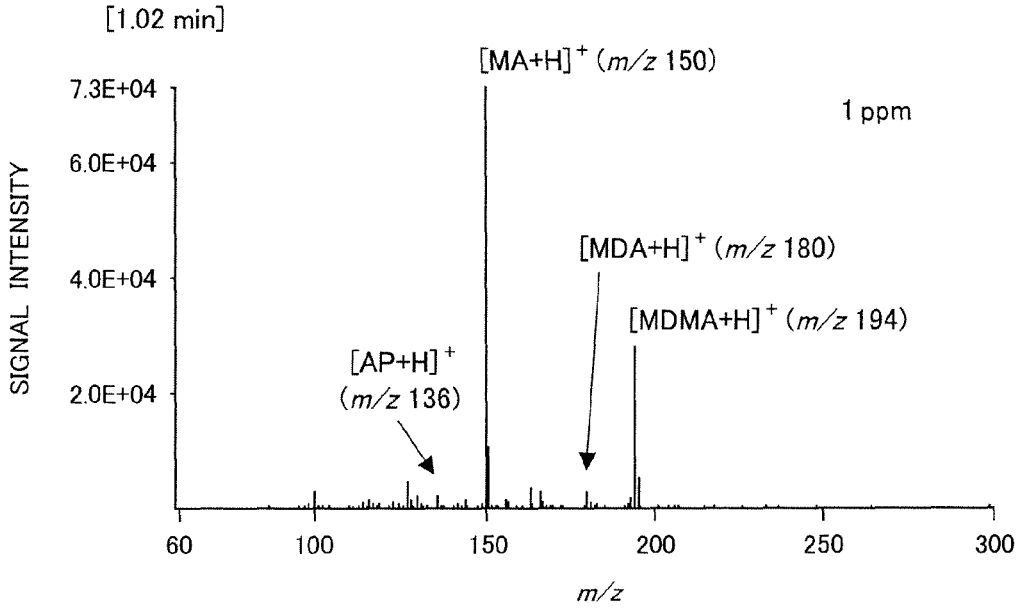
FIG. 8A is a mass spectrum of a drug (1 ppm) in a urine sample measured by a mass spectrometer in the modified example.
Figure 8B:
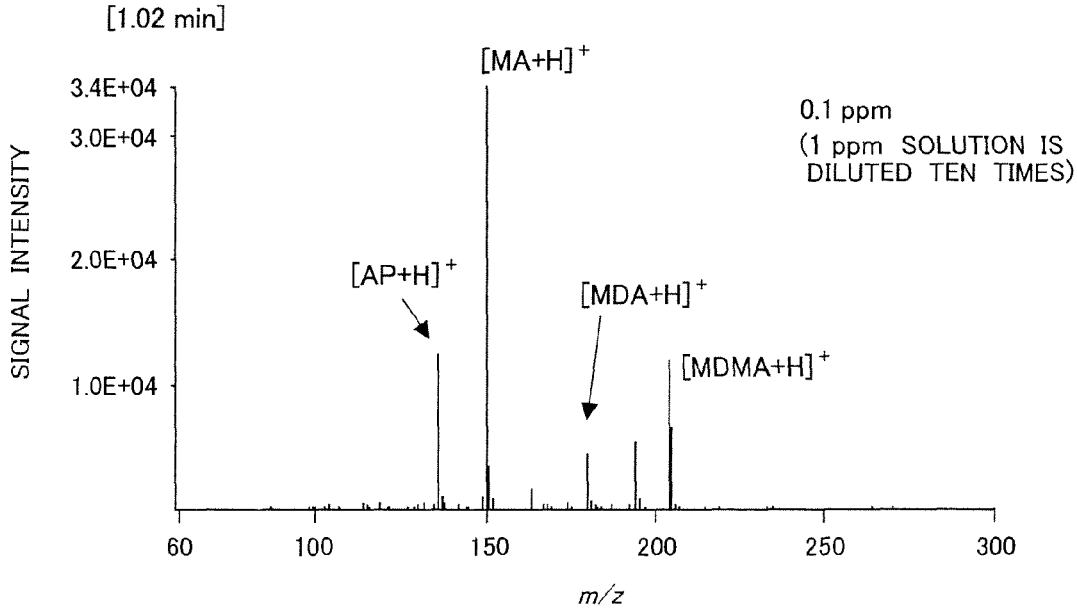
FIG. 8B is a mass spectrum of a drug (0.1 ppm) in a urine sample measured by the mass spectrometer in the modified example.

FIG. 8A and FIG. 8B show results obtained by analyzing a urine sample and a solution made by diluting the urine sample with distilled water as samples using a mass spectrometer having a configuration of FIG. 4. The horizontal axis represents m/z which is a ratio of mass m and electric charge z, and the vertical axis represents signal intensity.

FIG. 8A is a mass spectrum showing a results which is obtained by measuring a sample with the mass spectrometer which is prepared in a manner that 0.3 g of potassium carbonate is weighed in a sample container and 0.5 mL of the above-described urine sample was injected into the sample container, and then the sample container is sealed with a stopper and heated at 80° C. for 5 minutes.

In this case, the urine sample is an alkaline solution of 60% potassium carbonate.

Drugs intended to analyze are stimulant drugs or synthetic narcotic drugs. As previously described, these drugs are amine-based substances including nitrogen atom in their molecules.

Stimulant drugs and phenethylamine-based synthetic narcotic drugs form free amines in the alkaline aqueous solution including potassium carbonate. These free amines are volatile substances.

FIG. 8A shows an analyzed result (a mass spectrum) of a sample which includes four kinds of drugs (MA, AP, MDMA and MDA) in urine, in which each drug is included by 1 ppm.

FIG. 8B is an analyzed result (a mass spectrum) of a sample which is prepared in a manner that the urine sample which is the same sample in FIG. 8A is diluted ten times with distilled water and then 0.5 mL of the diluted sample is taken in the same way as in FIG. 8A.

In mass spectra of the same analyzed time, signal intensities of proton-added molecules of AP and MDA were low in FIG. 8A, while every four kinds of proton-added molecules were obviously detected in FIG. 8B.

FIGS. 9A to 9D show obtained results of mass chromatograms from fragment ions after MS/MS analysis. The horizontal axis represents analysis time, and the vertical axis represents signal intensity.

For each drug, mass chromatograms of blank measurement (60% potassium carbonate aqueous solution), a 1 ppm sample (in urine), a 0.1 ppm sample (in urine) and a 0.1 ppm sample (a sample which includes 1 ppm of drugs is diluted ten times with distilled water) were shown.

With respect to every drug, the chromatograms rise just after start of the analysis, and it was confirmed that each drug is detected.

Here, in the result of FIG. 8A (1 ppm), it was possible that four kinds of drugs were sufficiently detected and the substances were able to be determined from their spectrum patterns after MS/MS analysis of each drug.

However, from the results of FIGS. 9A to 9D, the time at which detected peaks of AP and MDA are obtained was later than the time at which detected peaks of MA and MDMA and detected sensitivity of AP and MDA was lower than the detected sensitivity of MA and MDMA.

In addition, in the mass spectrometer of FIG. 1 and FIG. 2, when analysis is performed by decreasing effect of impurity components, detected time becomes different in the case that four kinds of drugs are analyzed at one time.

This phenomenon is considered that detection is disturbed by the impurity components in the urine. It is also considered that the disturbance is also caused by difference in property of each substance (boiling point and vapor pressure), and each vaporization is competed.

FIGS. 9A to 9D show that, when the mass chromatogram in which a 1 ppm sample without dilution is analyzed is compared with the mass chromatogram in which a 0.1 ppm sample made by diluting is analyzed, the latter sample (the 0.1 ppm sample) has the time when the signal intensity becomes maximum for AP and MDA earlier than that in the former.

From this result, it can be said that four kinds of drugs becomes easy to be detected rapidly because effect of impurity components in urine is eased by diluting the urine sample with distilled water.

Figure 9A:
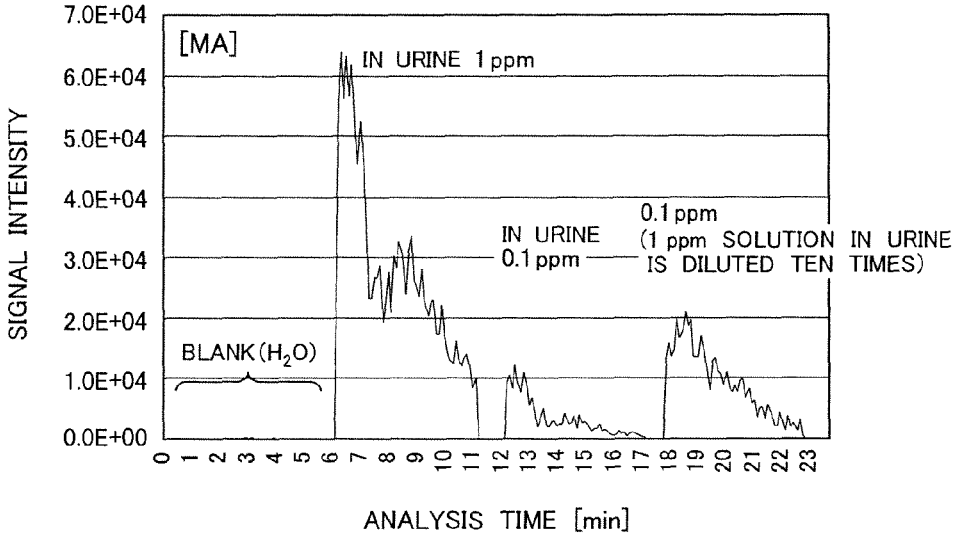
FIG. 9A is a graph showing a measurement result of a drug (MA) by the mass spectrometer in the modified example.
Figure 9B:
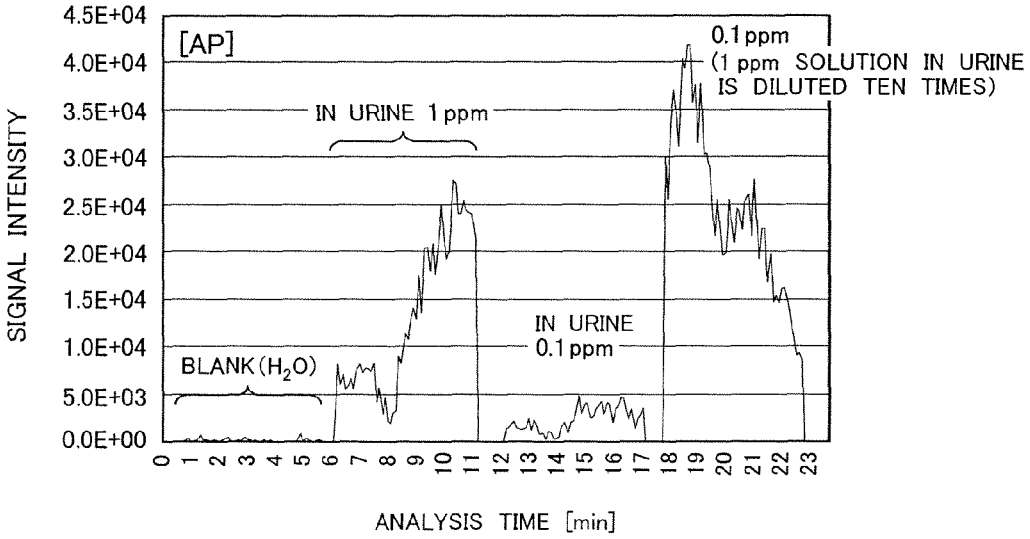
FIG. 9B is a graph showing a measurement result of a drug (AP) by the mass spectrometer in the modified example.
Figure 9C:
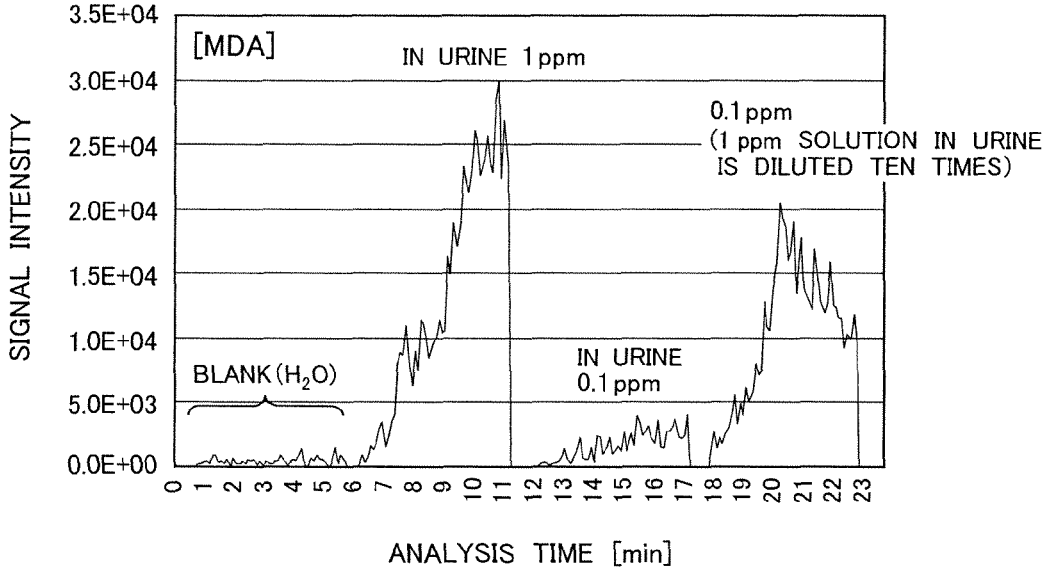
FIG. 9C is a graph showing a measurement result of a drug (MDA) by the mass spectrometer in the modified example.
Figure 9D:
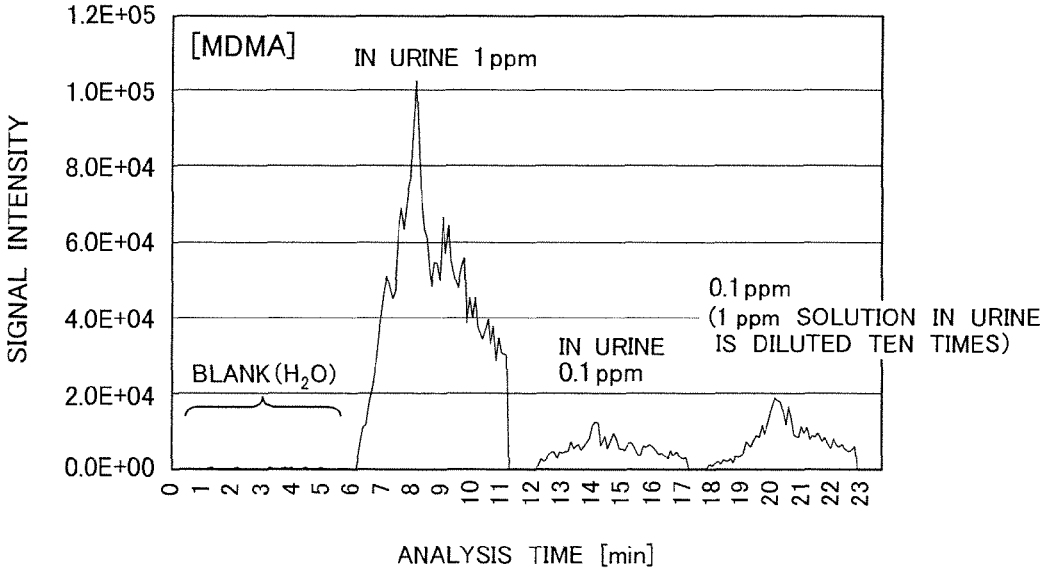
FIG. 9D is a graph showing a measurement result of a drug (MDMA) by the mass spectrometer in the modified example.
Figure 9E:
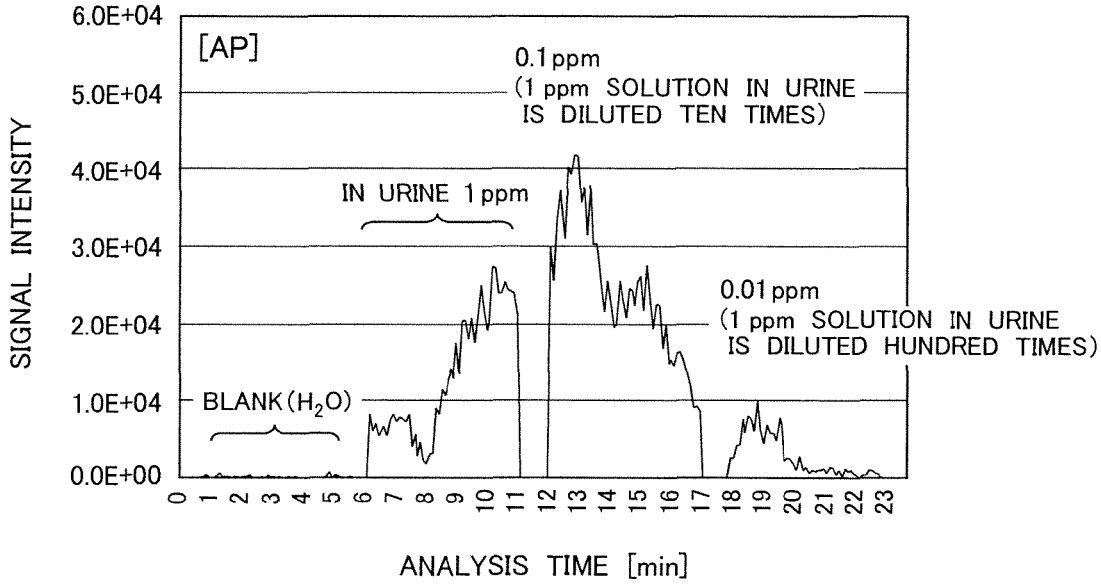
FIG. 9E is a graph showing a measurement result of a drug (AP) by the mass spectrometer in the modified example.

FIG. 9E shows results of mass chromatograms of AP when the 1 ppm sample without dilution is analyzed, when the 0.1 ppm sample made by diluting is analyzed, and when a 0.01 ppm sample made by diluting is analyzed. The horizontal axis represents analysis time, and the vertical axis represents signal intensity.

AP is also detected when the 1 ppm sample is diluted hundred times with distilled water (a 0.01 ppm sample).

Generally, when a sample is diluted in analysis, decrease in detection sensitivity may naturally occur. However, in this method, the four kinds of illegal drugs in urine can be rapidly analyzed at the same time due to improvement of the detection sensitivity of AP and MDA.

When the 1 ppm sample is diluted ten times with distilled water, the signal intensity of MA and MDMA in the diluted sample decreases compared with those of the 1 ppm sample. However, the sensitivity which is sufficient to detect is obtained.

Therefore, it was shown that the four kinds of illegal drugs in urine can be rapidly and easily detected even when the urine including the drugs is diluted about ten times with distilled water.

For the purpose of drug detection, all of the four kinds of drugs can be detected within 1 minute and determined.

As another method of this Example, the urine sample may be previously diluted with an alkaline aqueous solution such as 80% potassium carbonate aqueous solution.

In this case, when 0.250 ml of the urine sample and 0.250 mL of 80% potassium carbonate aqueous solution are mixed, a concentration of potassium carbonate is 40%. A concentration of potassium carbonate in a sample solution is desirably 30 to 60%.

Excellent results are obtained when heating temperature is set to 80° C. for 2 to 5 minutes.

Furthermore, a method for adding the potassium carbonate aqueous solution to a sample can be also applicable for powder and tablet samples of stimulant drugs and narcotic drugs.

An adequate amount of stimulant drug powder (for example, crystal) is transferred into a sample solution and potassium carbonate aqueous solution is further added. After sealing with a stopper, the resultant mixture is dissolved by a method such as shaking gently, and then heated. The obtained sample may be analyzed.

Example 4

Figure 10:
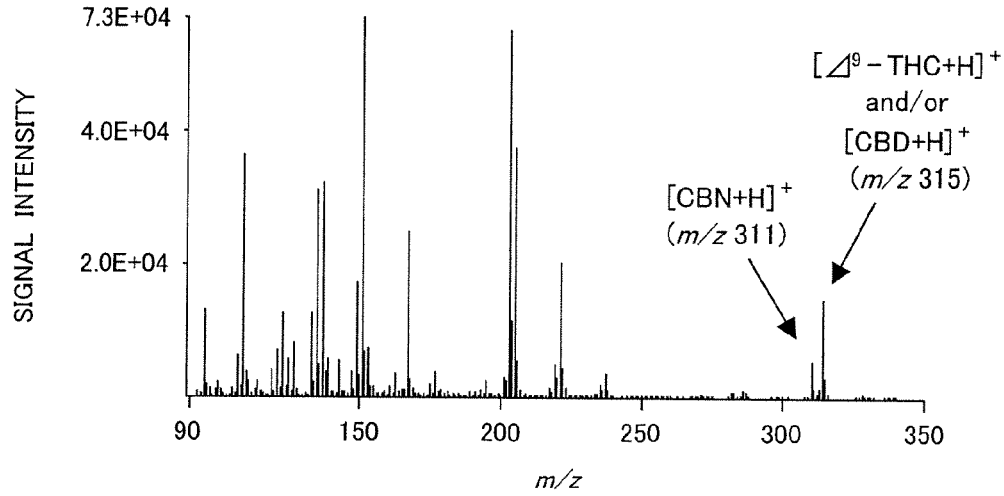
FIG. 10 is a mass spectrum of cannabis measured by a mass spectrometer in the modified example.

FIG. 10 shows a result of analyzing a cannabis sample. The horizontal axis represents m/z, and the vertical axis represents signal intensity.

FIG. 10 is amass spectrum which is the result of analyzing a sample which is prepared by adding 1 mL of 80% potassium carbonate aqueous solution to 1 mg of a powder sample of a cannabis resin and heating the obtained mixture at 150° C. for 5 minutes.

In this spectrum, a peak of m/z 311 shows ions of proton-added molecules of cannabinol (CBN) and the peak of m/z 315 shows ions of proton-added molecules of $\Delta^9$-tetrahydrocannabinol ($\Delta^9$-THC) or cannabidiol (CBD).

The above-described three kinds of substances are hallucinatory components specifically included in cannabis, and $\Delta^9$-THC is a target component for crackdown assigned as a narcotic drug.

By detecting these substances, it can be determined that the analyzed sample is cannabis.

In related art, drug components are extracted from a sample with an organic solvent such as methanol in analysis of cannabis (Non-Patent Document 4).

In addition, hallucinatory components in cannabis are required to be separated and purified by repeating operation such as liquid-liquid extraction.

In this Example, simple analysis is possible without the above-described operation.

For the cannabis sample, detection is possible for a sample to which distilled water is added as well as a sample to which an alkaline aqueous solution is added. Consequently, not a potassium carbonate aqueous solution but a solution after heating which is prepared by adding distilled water may be analyzed. When distilled water is used, an excellent result was obtained when 1 mL of distilled water is added to 1 mg of cannabis sample.

Example 5

Figure 11:
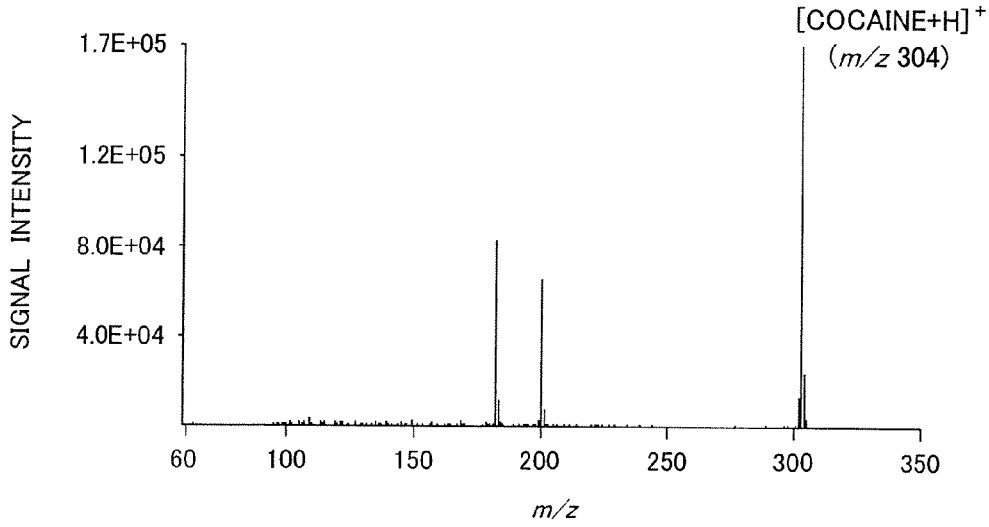
FIG. 11 is a mass spectrum of cocaine measured by a mass spectrometer in the modified example.

FIG. 11 is a result obtained by analyzing a cocaine sample. The horizontal axis represents m/z, and the vertical axis represents signal intensity.

In this Example, 0.1 g of potassium carbonate aqueous solution was weighed in a sample vial and then 200 μL of cocaine aqueous solution (50 μg/mL) was added. After sealing with a stopper, the mixture was heated at 80° C. for 5 minutes and analyzed.

In a method in related art, a color reaction is employed (Non-Patent Document 4) and a simple method for analysis has not been performed until now.

This mass spectrum is a result in which it is shown that the headspace analysis can be simply performed in a manner that a small amount of potassium carbonate is added to a cocaine aqueous solution to form alkaline solution and the solution is heated.

In addition, not a cocaine aqueous solution but a solution in which cocaine powder is dissolved in potassium carbonate aqueous solution can be also analyzed.

In this case, final concentration of the potassium carbonate aqueous solution is desirably 30 to 80%.

In the case of heating, sufficient detection is possible at 80° C. Moreover, a temperature range of 60 to 160° C. or a method in which temperature is gradually raised to the specified temperature may be used.

Example 6

Figure 12:
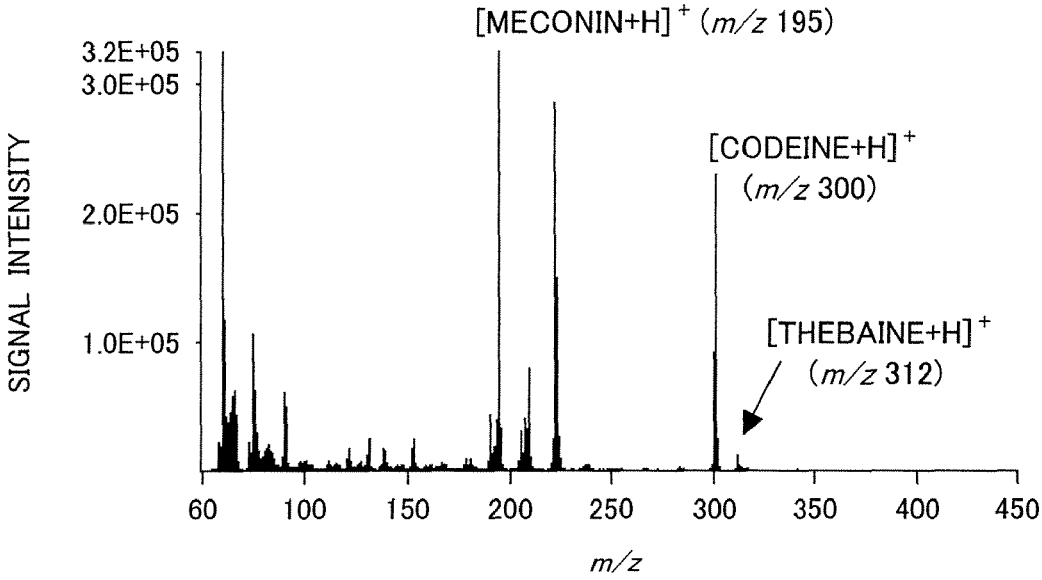
FIG. 12 is a mass spectrum of opium measured by a mass spectrometer in the modified example.

FIG. 12 is a result obtained by analyzing an opium sample. The horizontal axis represents m/z, and the vertical axis represents signal intensity.

This mass spectrum is a result obtained by headspace analysis of a sample which is prepared in a manner that 10 mg of an opium sample is weighed in a sample container and 200 μL of 80% potassium carbonate aqueous solution is added, and then the sample container is sealed with a stopper and heated at 150° C. for 5 minutes.

From this mass spectrum, meconin, codeine and thebaine which are specific substances of opium are detected. Consequently, it was shown that this method is applicable for detection of opium.

Meconin is an opium-specific component among the above-described substances.

Codeine and thebaine are types of opium alkaloids. These substances are assigned as regulated substances of crackdown target (narcotic drugs) even existing in a single substance.

For detection of opium, narcotic drug components referred to as opium alkaloids have been analyzed as target substances.

Here, opium alkaloids indicate illegal drug components such as morphine and codeine (Non-Patent Document 4).

On the contrary, the object of the drug detection equipment described in this Example is rapid detection of drugs and it is only necessary to obtain substances which can prove opium.

In this Example, it was shown that meconin, codeine and thebaine which were specific substances of opium were detected, and analyzed substances were identified from the spectrum pattern after CID, and therefore, detection of opium was possible.

Consequently, simple and rapid analysis was possible because troublesome operation such as extraction and purification operation for a color reaction and derivative-formation reaction for GC/MS analysis were unnecessary.

As shown in Examples 3 to 6, simple and rapid analysis for stimulant drugs and narcotic drugs in urine and a solid sample (powder, crystal and tablet) was possible.

Furthermore, when alkaline aqueous solution such as potassium carbonate aqueous solution is used, analysis, detection and determination can be possible by the common method in which all analysis samples are mixed in a sample container and the mixture is heated.

In Examples 3 to 6, potassium carbonate is used as a solute of alkaline aqueous solution. However, potassium hydroxide, sodium hydroxide and the like can be used as other solutes. A pH of alkaline aqueous solution is desirably 11 or higher. A concentration of solute of alkaline aqueous solution is desirably 30 to 80% and more desirably 30 to 60%.

Figure 13:
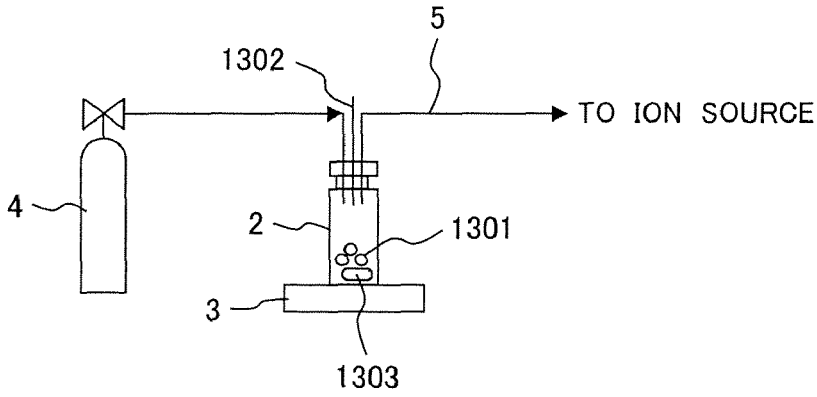
FIG. 13 is a block diagram showing a modified example of the mass spectrometer of FIG. 4.

FIG. 13 shows a sample container having a configuration for dissolving a solid sample.

In this diagram, a liquid injection tube 1032 for injecting alkaline aqueous solution or distilled water in order to dissolve a solid sample 1301 is provided in the vial container 2. A stirrer 1303 which rotates by magnetic force (a magnetic stirrer) is provided inside of the vial container 2.

When the solid sample 1301 is dissolved, the solid sample 1301 is dissolved in a manner that the solid sample 1301 is enclosed in the vial container 2, alkaline aqueous solution or distilled water being poured from the liquid injection tube 1302, and liquid in the vial container 2 being stirred by rotating the stirrer 1303. The liquid can be also stirred with heating the liquid by a heating heater 3.

Hereinafter, effect of the present invention is further described.

According to the present invention, determination can surely be performed because measured components themselves can be determined from mass numbers of substances and spectrum patterns obtained by MS/MS analysis.

In the case of a urine sample, stimulant drug components in the urine can be analyzed by previously weighing a small amount of potassium carbonate in the sample container and just adding the urine sample into the sample container. In addition, further increase in detection sensitivity is possible by heating.

In the case of a solid sample (powder, crystal, tablet and the like) of stimulant drugs and narcotic drugs, the sample can be detected by the method in which alkaline aqueous solution such as potassium carbonate aqueous solution is added and the mixture is heated in the sample container without troublesome extraction and purification operation. In other words, illegal drugs dissolved into urine and solid illegal drugs in the form of powder or tablet can simply and rapidly be analyzed.

In the case of cannabis, three kinds of reagents for the color reaction are not necessary. Also, in the case of cocaine, three kinds of reagents for the color reaction are not necessary. For opium, reagents for the color reaction are not necessary and detection is possible without steps of extraction and purification operation of opium alkaloids, derivative formation and the like.

Moreover, preparation methods are the same as three kinds of samples of cannabis, cocaine and opium.

What is claimed is:

1. A mass spectrometer comprising:
an ion source;
a mass spectrometry part;
a sample container;
a heater for the sample container;
a first gas tube connected to the sample container to introduce a gas into the sample container; and
a second gas tube connected to the sample container to transfer a headspace gas of the sample container to the ion source,
wherein the ion source generates ions of the headspace gas and the mass spectrometry part performs mass spectrometry of the ions.

2. The mass spectrometer according to claim 1,
wherein a downstream end part of the first gas tube is inserted in the sample solution.

3. The mass spectrometer according to claim 1,
wherein a downstream end part of the first gas tube is positioned in a headspace of the sample container.

4. The mass spectrometer according to claim 2,
wherein an upstream end part of the second gas tube is positioned in a headspace of the sample container.

5. The mass spectrometer according to claim 1,
wherein a temperature of the sample container is controlled by a temperature controller to increase a temperature of a sample in the sample container with time.

6. The mass spectrometer according to claim 1,
wherein the sample container is a liquid adsorption part for adsorbing a liquid sample.

7. The mass spectrometer according to claim 1,
wherein the liquid sample includes urine.

8. The mass spectrometer according to claim 1,
wherein a sample in the sample container is solid, and the sample container has a liquid injection tube for injecting alkaline aqueous solution or distilled water for dissolving the sample.

9. A method for mass spectrometry comprising the steps of:
encapsulating a sample in a sample container;
introducing an accompanied gas into an inside of the sample container;
vaporizing plural kinds of components included in the sample;
forming a sample gas by mixing the components and the accompanied gas; and
performing the mass spectrometry of the sample gas.

10. The method according to claim 9, wherein the mass spectrometry is performed for ions generated from the sample gas.

11. The method according to claim 9, wherein the components are vaporized from the sample at a controlled temperature.

12. The method according to claim 9, wherein the sample container is a liquid adsorption part for adsorbing a liquid sample.

13. The method according to claim 9, wherein the components are vaporized by heating the sample container and changing temperature of the sample with time.

14. The method according to claim 13, wherein the components are vaporized from the sample by raising the temperature stepwise.

15. The method according to claim 12, wherein the liquid sample includes a urine, and drugs and metabolized substances of the drugs included in the liquid sample are determined as targets of analysis.

16. The method according to claim 12, wherein an alkaline reagent is added to the liquid sample.

17. The method according to claim 12, wherein the liquid sample is diluted with adding distilled water.

18. The method according to claim 12, wherein the liquid sample is prepared with adding alkaline aqueous solution or distilled water to a solid sample.

19. The method according to claim 16, wherein liquid including the sample is heated to 60 to 160° C. and gas generated from the liquid is transferred to the mass spectrometry part.

* * * * *